United States Patent [19]

Waclawik et al.

[11] 4,185,345

[45] Jan. 29, 1980

[54] NEG'ATOR SPRING POWERED UNDERWATER LAUNCHING DEVICE

[75] Inventors: Francis J. Waclawik, Bristol; James P. Muzaca, Tiverton, both of R.I.; Robert A. Cook, Swansea; William A. Hardin, Westport, both of Mass.; Alfred D. Silvia, Portsmouth, R.I.; Ronald Correia, Fall River, Mass.

[73] Assignee: The United States of America as represented by the Secretary of the Navy, Washington, D.C.

[21] Appl. No.: 899,184

[22] Filed: Apr. 24, 1978

[51] Int. Cl.[2] ..... B63B 21/52

[52] U.S. Cl. ..... 9/8 R; 89/1.809; 114/238; 114/318; 114/326

[58] Field of Search ..... 114/323-328, 114/339, 312, 318-320, 238, 239; 9/9, 8 R; 89/1.809, 1.810; 267/156; 244/63

[56] References Cited

U.S. PATENT DOCUMENTS

| | | | |
|---|---|---|---|
| 1,741,827 | 12/1929 | Cooke | 114/324 |
| 1,821,219 | 9/1931 | Kelley | 114/327 |
| 2,419,162 | 4/1947 | Pope, Sr. | 9/9 |
| 3,154,280 | 10/1964 | Wiese | 267/156 |

*Primary Examiner*—Sherman D. Basinger
*Attorney, Agent, or Firm*—Richard S. Sciascia; Arthur A. McGill; Prithvi C. Lall

[57] ABSTRACT

A launching mechanism is provided for ejecting a small buoy from a high speed deep depth submersible. The buoy is held in place and constrained by a pair of latch levers that lock into a groove in the buoy tail piece. The latch levers are held in place by locking pins. On launch a solenoid valve is operated allowing ambient sea pressure to actuate a release system. The sea pressure retracts a release piston assembly to which the locking pins are attached. Upon withdrawal of the locking pins, the latch levers are released by the force of neg'ator ejection springs. The ejection springs accelerate an open ended cage containing the buoy through a four foot displacement. The buoy strikes a plunger actuating a muzzle plug release mechanism that permits ejection of the buoy from the launch cage.

4 Claims, 7 Drawing Figures

NEG'ATOR SPRING POWERED UNDERWATER LAUNCHING DEVICE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention generally relates to launchers and more particularly to a system for ejecting a small buoy at deep depths from a submerged submarine traveling at any speed within the submarines capability.

Prior systems are capable of performing similar functions at only shallow depths and low platform speeds. These are normally hydro-pneumatic or gas generated powered launchers. The limitations and disadvantages generally associated with these prior art devices are large power requirements, high noise levels, lack of simplicity, low vehicle exit velocity and uneven inefficient ejection force applied to the buoy resulting in less efficient systems for attaining a specific exit velocity.

SUMMARY OF THE INVENTION

It is therefore a general object of the present invention to provide an improved launcher. In addition the system is to be compact and suitable for use at high speeds and deep depths. Further objects are that the system be self-contained and provide a quiet launch, efficient use of power, safe operation, low cost, long life and reliability. These and other objects of the invention and the various features and details of construction and operation will become apparent from the specification and drawings.

This is accomplished in accordance with the present invention by providing a projectile that is accelerated inside a launching cage and emitted underwater from a deep depth submersible. The projectile then rises to the surface of the water. The launching cage is accelerated in response to predetermined conditions by neg'ator springs. A hydraulically operated latching mechanism triggers the system by releasing its restraint on the buoy and launching cage. The latching mechanism has both electrical and hydraulic actuators. The system has a muzzle capable of inhibiting the inward flow of water or ice to the system but which cannot withstand the outward impact of the projectile during launch.

DESCRIPTION OF THE PREFERRED EMBODIMENT

Figure 1:
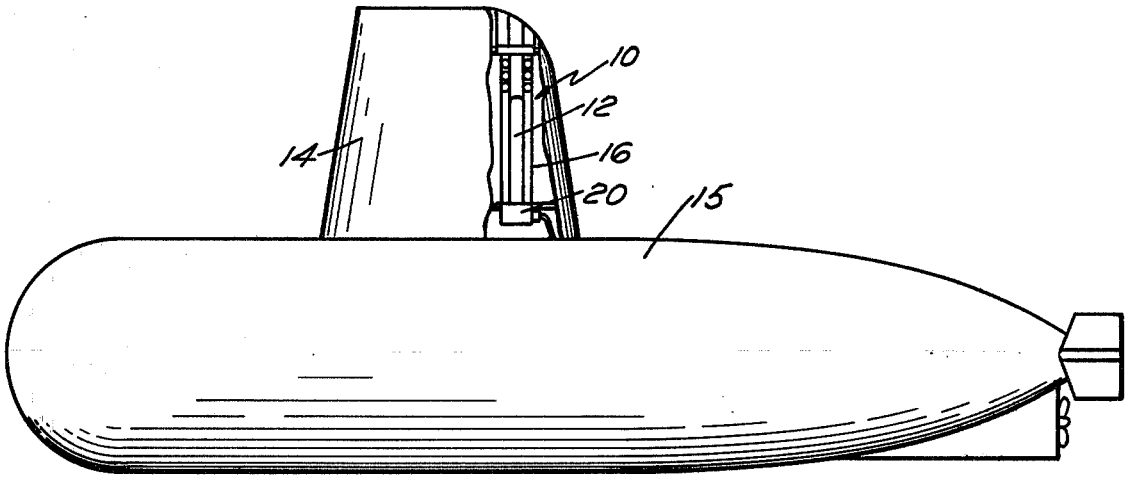
FIG. 1 is a view of the launching device located in an underwater submersible vehicle.

Referring now to FIG. 1, there is shown a launcher system 10 suitable for ejecting a small buoy 12 from the sail 14 of a high speed, deep depth submersible 15. A main tube 16 forms the outer shell of the launcher 10 and houses all launcher assemblies. A release unit 20 connected to the breach end of main tube 16 houses the control units for the operation of the system.

Figure 2:
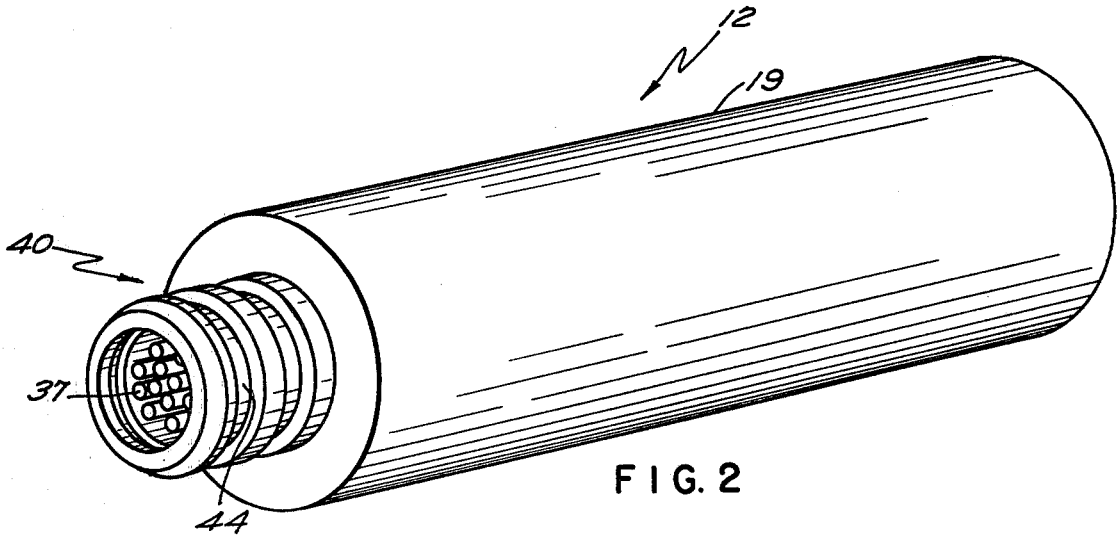
FIG. 2 is a perspective view of the buoy shown in FIG. 1.

Referring to FIG. 2 the buoy 12 comprises a buoy tail piece 40 connected to a cylindrical shell 19. The buoy tail piece has an electrical connector 37 and a circumferential groove 44.

Figure 3:
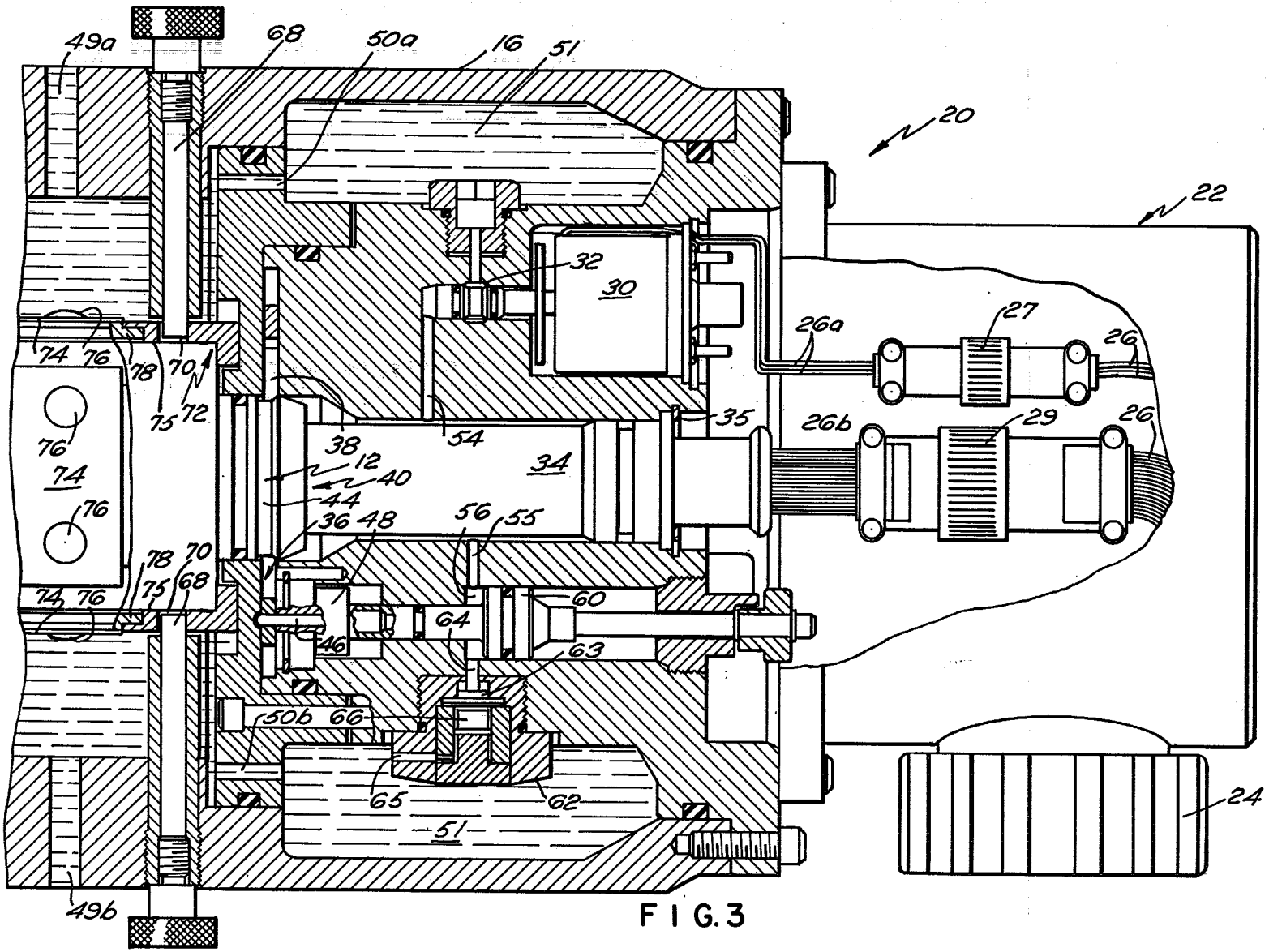
FIG. 3 is a view partly in section of the release unit shown in FIG. 1.

In FIG. 3 there is shown a more detailed view of the release unit 20. The release unit 20 forms a totally enclosed and sealed assembly. It includes an electrical junction box 22 having a hermetically sealed watertight connector 24 welded to box 22. A plurality of electrical wires 26 emanating from connector 24 pass through connectors 27 and 29 into respective wire groups 26*a* and 26*b* for conducting electrical signals to various launcher components. The pair of wires 26*a* are connected to a solenoid firing valve 30 for electrically operating the valve piston 32. The wires 26*b* connect to an umbilical shaft assembly connector 34 for providing electrical connection from the junction box 22 to the buoy 12 for data input and function checking wires.

This umbilical shaft assembly connector 34 is fastened at its aft end to the release unit housing 20 by means of a retention ring 35. The forward end of the umbilical shaft assembly connector 34 passes into the buoy tail piece 40 and plugs into buoy tail piece connector 37 (FIG. 2). At launch, the buoy tail piece connector 37 disconnects from connector 34. Umbilical shaft assembly connector 34 provides a single, pullout disconnect to be utilized for electrical interface with the buoy 12.

Figure 4:
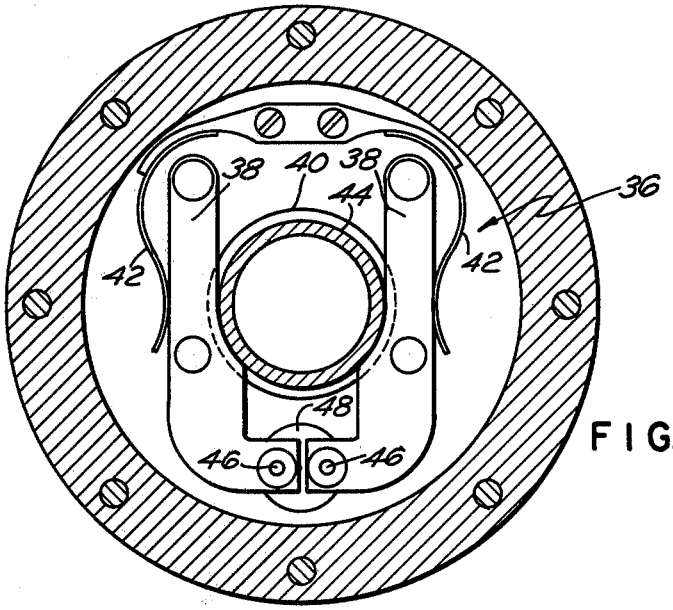
FIG. 4 is a view of the locking mechanism shown in FIG. 3.

A locking mechanism 36 including a pair of transverse latch levers 38 restrain the buoy 12 by clamping onto groove 44 of the buoy tail piece 40. The operation of this locking mechanism 36 is more clearly shown by referring to FIGS. 2, 3 and 4. In an actual loading and launching cycle the buoy tail piece 40 is drawn back spreading transverse latch levers 38 which being spring loaded by spring assembly 42 clamp the circumferential groove 44 in the buoy tail piece 40. The latch levers 38 are then secured by tapered locking pins 46 attached to the end of a release piston 48.

Referring once more solely to FIG. 3, there are shown ports 49*a*, 49*b*, 50*a* and 50*b* for admitting seawater to opening 51. Upon operation of solenoid valve 30, valve piston 32 is actuated allowing the sea water in opening 51 to flow through a filtered inlet 58 and passage tubes 54 and 55 to operate release piston 48. The water from passage 54 enters a chamber 56 and pushes plunger 60, thereby forcing release piston 48 in the aft direction. This withdraws tapered locking pins 46 from the latches 38 allowing the release of buoy tail piece 40.

As a backup system for launch initiation, a rupture disc valve 62 has also been included in the system. The rupture disc valve 62 is hydraulically interfaced to release piston 48 through opening 64 to chamber 56. A rupture disc 63 functions when the ambient sea pressure, entering inlet port 65, exceeds a predetermined minimum. This admits ambient sea pressure to operate the release piston 48 in the same manner as solenoid valve 30.

A combination dirt and high frequency shock filter 66 is incorporated at rupture disc 62 inlet port 65 in order to preclude malfunctioning of the disc 62 due to orifice clogging or high pressures caused by near miss explosions.

Locking pins 68 are inserted in apertures 70 in side plates 75 of launch cage 72 when the system is primed for launch during dockside preparation for submarine installation. These pins 68 provide a positive stop on launch cage 72 to prevent firing of the cage 72 regardless of the operation of locking mechanism 36. To activate the system for normal operation the pins 68 are withdrawn from apertures 70 at time of submarine installation.

Figure 6:
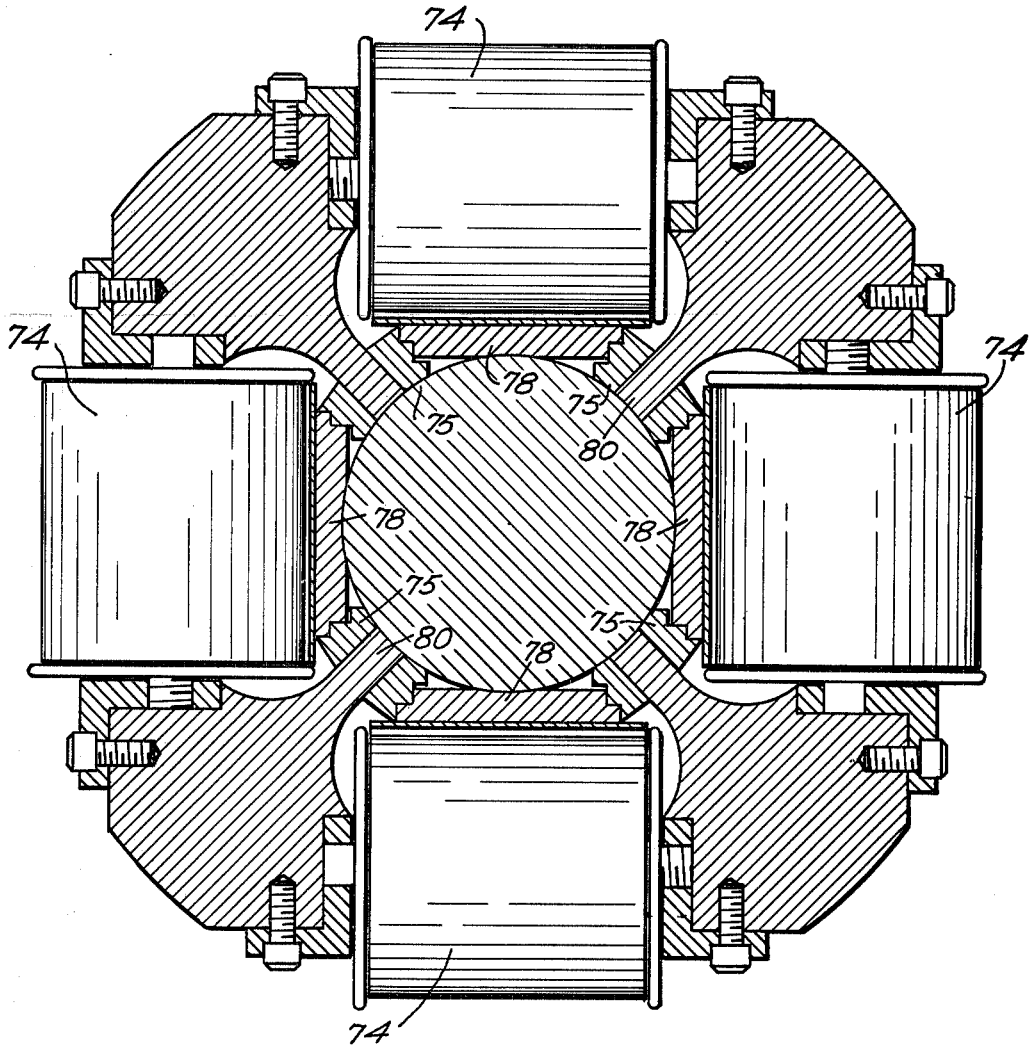
FIG. 6 is a cross-sectional view showing the springs attached to the launch cage on the guide rails in the launching device of FIG. 1.
Figure 5:
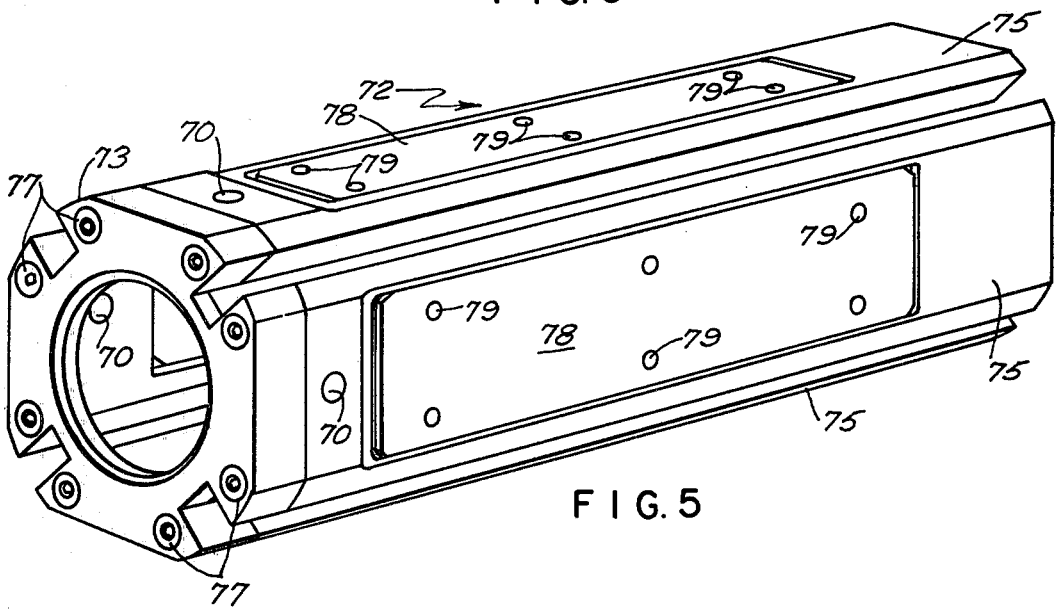
FIG. 5 is a view of the launch cage partially shown in FIG. 3.

FIG. 5 is a perspective view of the launch cage 72. An end plate 73 is connected to four side plates 75 by means of bolts 77. The side plates 75 have apertures 70 for previously described locking pins 68. Each side plate 75 accommodates a launch catapult plate 78. Each plate 78 has three pairs of apertures 79 for riveting neg'ator constant force power springs 74 (FIGS. 6 and 7) to plate 78.

Figure 7:
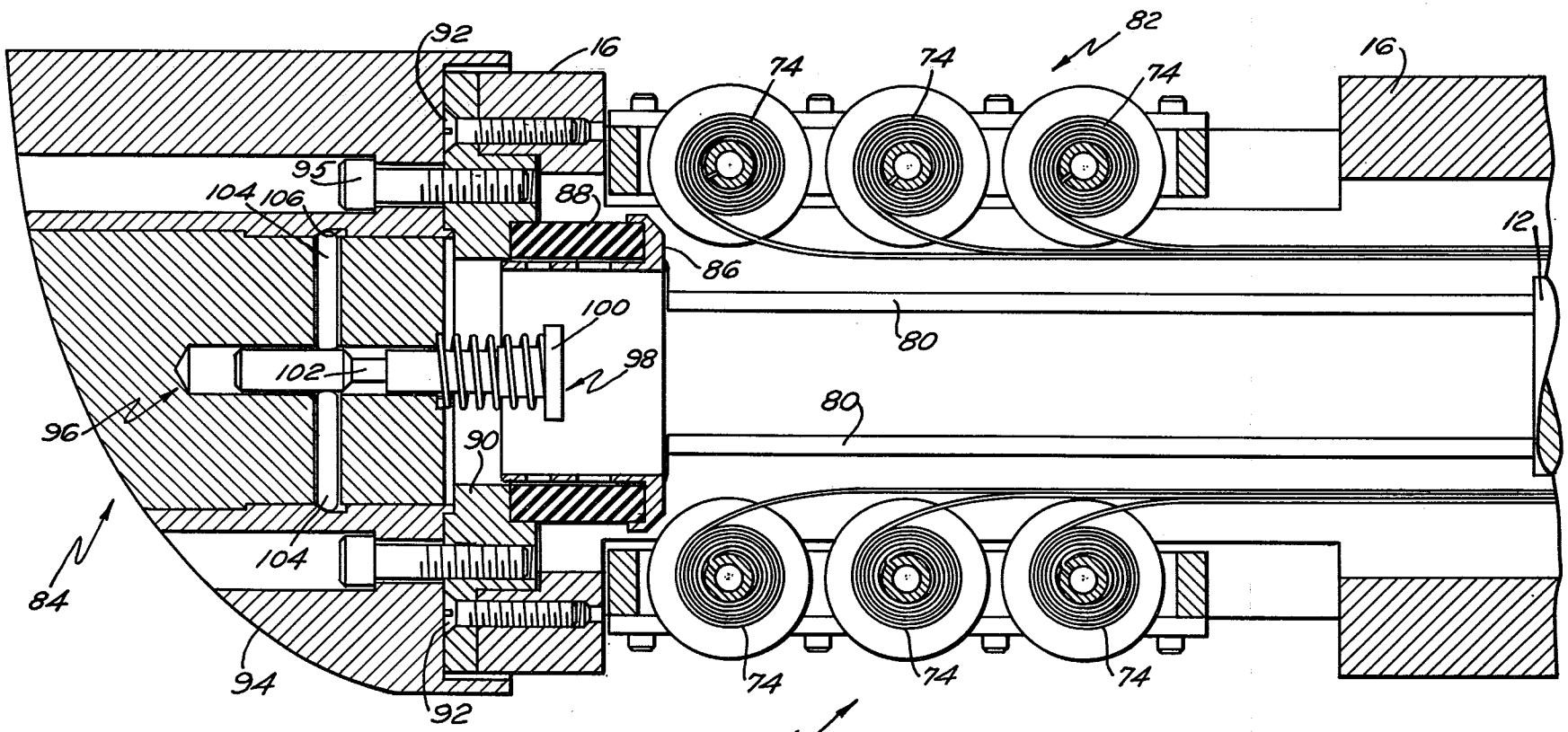
FIG. 7 is a cross-sectional view of the muzzle end of the launching device of FIG. 1.

For a further description of the system refer now to all the figures. FIG. 7 is an extension of FIG. 3 with intermediate lengths omitted. FIG. 7 is drawn to a smaller scale than FIG. 3. Motivation of the launch cage 72 is provided by a plurality of constant force power springs 74 which are attached by rivets 76 to the launch catapult plate 78 of launch cage 72. In addition, the main tube 16 contains four molded guide rails 80 which serve as a launch runway for the cage 72 that is holding buoy 12.

Groups of three power springs 74 form a power spring assembly 82. The spring assemblies 82 are located near the muzzle opening 84 of the launcher 10 at four positions on the cross-sectional circumference, equally spaced at 90° positions between the four guide rails 80. When the release unit 20 is operated, the launch cage 72 is accelerated along the rails 80 toward the muzzle end opening 84 of the launcher 10. A metal stop 86 resting on a cylindrical rubber bumper 88 provides a cushioned stop for the launch cage 72. The rubber bumper 88 is affixed to a top cover 90 which is bolted to the main tube 16 by means of bolts 92.

A fairing cap 94 and pop-out muzzle plug assembly 96 are mounted on the top cover 90. The fairing cap 94 is secured by means of bolts 95. The cap 94 and plug 96 provide a hydrodynamic fairing into the submersible 15 in which the launcher 10 is mounted. The cap 94 provides the front mount of the launcher.

The actuation of the pop-out muzzle plug assembly 96 is caused by the buoy 12 as it is passing through an aperture 98 in top cover 90 striking and depressing a plunger 100. As plunger 100 moves forward a neck 102 aligns itself with pins 104. The pins 104 are forced inward away from tapered groove 106 of fairing cap 94 as the buoy 12 momentum forces plug assembly 96 forward. Muzzle plug assembly 96 is now free of restraint to be ejected with buoy 12.

For an overall description of the launching of the buoy 12 refer again to all the figures. Prior to operation, the locking pins 68 have been removed and the transverse latches 38 of locking mechanism 36 are clamped onto the circumferential groove 44 on buoy tail piece 40 thereby holding both the buoy 12 and launch cage 72 in place. The holding of the tail piece 40 overcomes the force exerted by power springs 74 trying to thrust the launch cage 72 forward.

The launch is then initiated by either operation of the solenoid valve 30 or rupture disc valve 62. Either causes the flow of sea water into chamber 56. This forces the release piston 48 to move aft withdrawing tapered locking pins 46 from transverse latches 38. This releases buoy tail piece 40. Power springs 74 then thrust the launch cage 72 and the captured buoy 12 toward the muzzle opening 84 along rails 80. Stop 86 halts launch cage 72 but does not obstruct buoy 12. Buoy 12 strikes plunger 100 actuating pop-out muzzle plug assembly 96. Buoy 12 along with muzzle plug assembly 96 are ejected from the launcher 10.

There has therefore been described a system for manually ejecting a small buoy 12 from a submersible 15 or for the automatic operation of the ejection after the sea water has reached some predetermined pressure. The system is suitable for all speeds and depths normally encountered and for depths in excess of those normally encountered.

It will be understood that various changes in the details, materials, steps and arrangements of parts, which have been herein described and illustrated in order to explain the nature of the invention, may be made by those skilled in the art within the principle and scope of the invention as expressed in the appended claims.

What is claimed is:

1. An underwater launching device comprising:

a buoy adaptable for underwater launch;

a cage having an opening at one end, said cage adapted to hold said buoy prior to launch;

restraining and release means positioned for restraining said buoy and said cage prior to launch and for initiating launch by releasing said buoy and said cage;

acceleration means connected to said cage for accelerating said cage and said buoy upon release of said buoy;

guide means aligned with said cage for guiding said cage a predetermined distance upon operation of said acceleration means;

deceleration means aligned with said cage for stopping said cage after said cage has been guided by said guide means the predetermined distance; and muzzle pop-out plug means aligned with said buoy for providing protection to said buoy from external forces prior to launch and for ejecting with negligible obstruction and degradation to said buoy at launch, said muzzle pop-out plug means further comprises a muzzle plug release mechanism including a plunger aligned with said buoy, said mechanism adapted to be actuated when said plunger is struck by said buoy and further including a pair of pins adapted for gripping sidewalls prior to actuation and adapted for releasing said sidewalls upon actuation, and a plug adapted for providing protection to said buoy from external forces prior to actuation of said muzzle plug release mechanism and for ejecting with negligible obstruction and degradation to said buoy upon actuation of said muzzle plug release mechanism.

2. An underwater launching device comprising:

a buoy adaptable for underwater launch;

a cage having an opening at one end, said cage adapted to hold said buoy prior to launch;

restraining and release means positioned for restraining said buoy and said cage prior to launch and for initiating launch by releasing said buoy and said cage;

acceleration means connected to said cage for accelerating said cage and said buoy upon release of said buoy;

guide means aligned with said cage for guiding said cage a predetermined distance upon operation of said acceleration means;

deceleration means aligned with said cage for stopping said cage after said cage has been guided by said guide means the predetermined distance, said deceleration means further includes a cylindrically shaped stop having an aperture larger than said buoy and smaller than said cage, and a cylindrical rubber bumper abutting and axially aligned with said stop for absorbing shock forces on said stop; and muzzle pop-out plug means aligned with said buoy for providing protection to said buoy from external forces prior to launch and for ejecting with negligible obstruction and degradation to said buoy at launch.

3. An underwater launching device comprising:

a buoy adaptable for underwater launch;

a cage having an opening at one end, said cage adapted to hold said buoy prior to launch;

restraining and release means positioned for restraining said buoy and said cage prior to launch and for initiating launch by releasing said buoy and said cage, said restraining and release means further includes a rupture disc valve adapted to restrain sea water prior to the sea water pressure exceeding a predetermined level and to conduct the sea water upon the sea water pressure exceeding the predetermined level, a release piston assembly hydraulically connected to said rupture disc valve, said release piston assembly being actuated upon the conduction of sea water by said rupture disc valve, and a latch mechanism connected to said release piston assembly, said latch mechanism positioned to restrain said buoy and said cage prior to actuation of said release piston assembly and for releasing said buoy and said cage upon actuation of said release piston assembly;

acceleration means connected to said cage for accelerating said cage and said buoy upon release of said buoy;

guide means aligned with said cage for guiding said cage a predetermined distance upon operation of said acceleration means;

deceleration means aligned with said cage for stopping said cage after said cage has been guided by said guide means the predetermined distance; and muzzle pop-out plug means aligned with said buoy for providing protection to said buoy from external forces prior to launch and for ejecting with negligible obstruction and degradation to said buoy at launch.

4. An underwater launching device comprising:

a buoy adaptable for underwater launch;

a cage having an opening at one end, said cage adapted to hold said buoy prior to launch;

restraining and release means positioned for restraining said buoy and said cage prior to launch and for initiating launch by releasing said buoy and said cage, said restraining and release means further includes a solenoid valve adapted to restrain sea water prior to actuation and to conduct sea water upon actuation, a release piston assembly hydraulically connected to said solenoid valve, said release piston assembly being actuated upon the conduction of sea water by said solenoid valve, and a latch mechanism connected to said release piston assembly, said latch mechanism positioned to restrain said buoy and said cage prior to actuation of said release piston assembly and for releasing said buoy and said cage upon actuation of said release piston assembly;

acceleration means connected to said cage for accelerating said cage and said buoy upon release of said buoy;

guide means aligned with said cage for guiding said cage a predetermined distance upon operation of said acceleration means;

deceleration means aligned with said cage for stopping said cage after said cage has been guided by said guide means the predetermined distance; and muzzle pop-out plug means aligned with said buoy for providing protection to said buoy from external forces prior to launch and for ejecting with negligible obstruction and degradation to said buoy at launch.

* * * * *